US005852249A

United States Patent [19]

Steinberg et al.

[11] Patent Number: 5,852,249

[45] Date of Patent: Dec. 22, 1998

[54] ELONGATED STRING SUPPORT FOR A STRINGED MUSICAL INSTRUMENT

[75] Inventors: Grant Kenneth Steinberg, Plympton Park; John Philip Dunlop Chaplin, Fullarton, both of Australia; Scott N. Quinn, Huntington Beach, Calif.

[73] Assignees: Actodyne General, Inc., Actodyne-Huntington Beach, Calif.; Integral Developments Pty. Ltd., Integral-Sydney, Australia

[21] Appl. No.: 888,166

[22] Filed: Jul. 3, 1997

Related U.S. Application Data

[63] Continuation-in-part of Ser. No. 657,158, Jun. 3, 1996, abandoned.

[51] Int. Cl.[6] ..... G10D 3/00

[52] U.S. Cl. ..... 84/293; 84/314 R

[58] Field of Search ..... 84/293, 314 R, 84/267

[56] References Cited

U.S. PATENT DOCUMENTS

| | | | |
|---|---|---|---|
| D. 363,946 | 11/1995 | Eberlen | D17/14 |
| 554,828 | 2/1896 | Maldura | 84/307 |
| 1,290,177 | 1/1919 | Grimson | 84/314 R |
| 2,816,469 | 12/1957 | Gossom | 84/293 |
| 3,319,504 | 5/1967 | Appleton | 84/314 R |
| 3,398,622 | 8/1968 | Smith | 84/267 |
| 3,398,623 | 8/1968 | Smith | 84/267 |
| 3,426,638 | 2/1969 | Smith | 84/291 |
| 3,688,632 | 9/1972 | Perez | 84/314 R |
| 3,691,285 | 9/1972 | Larrison | 84/726 |
| 3,739,072 | 6/1973 | Smith | 84/291 |
| 3,785,239 | 1/1974 | Smith | 84/314 R |
| 4,023,460 | 5/1977 | Kuhnke | 84/314 R |
| 4,311,078 | 1/1982 | Falgares | 84/314 R |
| 4,534,260 | 8/1985 | Burrell | 84/293 |
| 4,635,522 | 1/1987 | Excellente | 84/291 |
| 4,852,450 | 8/1989 | Novak | 84/314 R |
| 4,919,029 | 4/1990 | Excellente | 84/291 |
| 5,113,737 | 5/1992 | Grerory | 84/267 |
| 5,133,239 | 7/1992 | Thomas | 84/314 R |
| 5,347,904 | 9/1994 | Lawrence | 84/291 |
| 5,571,980 | 11/1996 | Busley | 84/263 |

*Primary Examiner*—William M. Shoop, Jr.
*Assistant Examiner*—Shih-yung Hsieh
*Attorney, Agent, or Firm*—Bliss McGlynn, P.C.

[57] ABSTRACT

An elongated string support for a stringed musical instrument includes a finger-board surface having a bass side and a treble side and extending between a proximal end and a distal end relative to the stringed musical instrument to support strings in close proximity thereto. The finger-board surface follows a longitudinally twisted path with an angle of twist increasing progressively from the proximal end to the distal end and the finger-board surface has a non-uniform radius extending between at least either one of the bass side and the treble side and one of the proximal end and the distal end.

19 Claims, 4 Drawing Sheets

ELONGATED STRING SUPPORT FOR A STRINGED MUSICAL INSTRUMENT

CROSS-REFERENCE TO RELATED APPLICATION(S)

The present application is a continuation-in-part of U.S. Ser. No. 08/657,158, filed Jun. 3, 1996, now abandoned.

BACKGROUND OF THE INVENTION

1. Field of the Invention

The present invention relates generally to stringed musical instruments and, more particularly, to an elongated string support for strings of a stringed musical instrument.

2. Description of the Related Art

Stringed musical instruments, such as guitars, generally include a body formed with an elongated string support or neck for strings and a head-stock at one end of the neck. The strings are tensioned over a bridge on the body at one end and a nut at the other end adjacent the head-stock. The head-stock usually incorporates a string tension adjusting mechanism. The neck includes a fretboard or finger-board which provides a player of the stringed musical instrument with a choice of selecting individual notes or chords by depressing manually the string or strings onto the finger-board, thereby effectively shortening them.

The practice of string bending is extremely common among players of stringed musical instruments. The reason for bending strings is to actively raise the pitch of a note over time, creating a desirable audio effect. Some players bend strings predominately in an upward direction (i.e., pushing the higher strings up) while others bend strings predominately in a downward direction (i.e., pulling the lower strings down).

Conventionally, the neck and finger-board are formed so as to lie in a straight plane which remains fixed in relation to a plane of the body and without any twisting. Stringed musical instrument manufactures have always placed a heavy emphasis on the straightness and accuracy of the neck and finger-board. The accuracy with which the neck is manufactured is important in providing an acceptable "action" or relationship between the strings and the finger-board whether fretted or fretless. However, the traditional straight neck can cause the player to suffer stress of the wrist joint when accessing complex chord formations particularly at the distal end of the head-stock, due to the need for continuous finger-hand-wrist adjustment coupled with a high degree of wrist flexion. This continued excessive flexion of the wrist can cause a range of repetitive strain injuries such as Carpal Tunnel Syndrome, tendinitis and tenosynovitis. These injuries are well documented as common in professional and frequent recreational players of stringed musical instruments.

One attempt to solve the above has been to relate the neck relative to the bridge on the body of the stringed musical instrument. Such an example is disclosed in U.S. Pat. No. 4,534,260 to Burrell. This patent discloses a stringed musical instrument having a bridge and neck rotated relative to one another about a longitudinal axis of the neck. The bridge may be flat or crowned. The stringed musical instrument has a fretboard twisted progressively throughout its length to correspond to the rotation.

One disadvantage of the above patented stringed musical instrument is that during the actual playing of the instrument with such a neck/finger-board, the player can inadvertently and undesirably "choke" the vibration of the strings while undertaking the common practice of "bending" strings. For example, the string or strings being fretted and "bent" down will invariably come into contact with one or more of the higher frets, thus "choking" or damping the string's vibrations and inevitably causing the strings to buzz against the higher frets or stopping the sustain of the note completely. This disadvantage is even more apparent if the action of the stringed musical instrument has been set very low, i.e., the strings are adjusted to be as close as possible to the frets. This disadvantage also arises when players of such a stringed musical instrument generate vibrato effects by both pushing and pulling the fretted strings across the frets rapidly.

SUMMARY OF THE INVENTION

It is, therefore, one object of the present invention to provide an elongated string support for a stringed musical instrument which allows the instrument to be played over the length of the string support with the wrist flexion maintained in a relatively neutral position.

It is another object of the present invention to provide an elongated string support for a stringed musical instrument which reduces "choking" caused by bending the strings downwards, setting a low action or generating vibrato techniques.

It is yet another object of the present invention to provide an elongated string support for a stringed musical instrument which minimizes fret buzz that results from a convexity of a twisted fretboard surface taken along a line from a treble string at a nut to a bass string at a bridge on the stringed musical instrument.

It is a further object of the present invention to provide a stringed musical instrument having an elongated string support which allows the instrument to be played far more comfortably and at a satisfactory level.

To achieve the foregoing objects, the present invention is an elongated string support for a stringed musical instrument including a finger-board surface having a bass side and a treble side and extending between a proximal end and a distal end relative to the stringed musical instrument to support strings in close proximity thereto. The finger-board surface follows a longitudinally twisted path with an angle of twist increasing progressively from the proximal end to the distal end. The finger-board surface has a non-uniform radius extending between at least either the bass side and treble side and/or the proximal end and the distal end.

One advantage of the present invention is that a twisted elongated string support or neck is provided for a stringed musical instrument. Another advantage of the present invention is that the twisted neck of the present invention has a variety of applications and is applicable to stringed musical instruments including, but not limited to, both acoustic and electric guitars, violins, banjos, cellos, and the like and can be applied to twisted finger-boards of either the fretted of fretless type. Yet another advantage of the present invention is that the player of the stringed musical instrument avoids having to play complex (e.g., barre) chords requiring significant finger pressure, with a highly flexed ('cocked') wrist, particularly at the distal end of the neck, thereby avoiding excessive wrist strain because the players's wrist is maintained in a substantially neutral position at all points along the finger-board. Still another advantage of the present invention is that the elongated string support has specialized radiusing to reduce "fret buzz" and "choking" while still allowing the stringed musical instrument to be played comfortably.

Other objects, features and advantages of the present invention will be readily appreciated as the same becomes better understood after reading the subsequent description taken in conjunction with the accompanying drawings.

BRIEF DESCRIPTION OF THE DRAWINGS

FIGS. 2(*a*) and 2(*b*) show various sectional profiles along a length of the elongated string support for a flat fretted finger-board for a left-handed player and a curved fretted finger-board for a right-handed player, respectively, and which are compared with sectional profiles of typical conventional designs.

DESCRIPTION OF THE PREFERRED EMBODIMENT(S)

Figure 1:
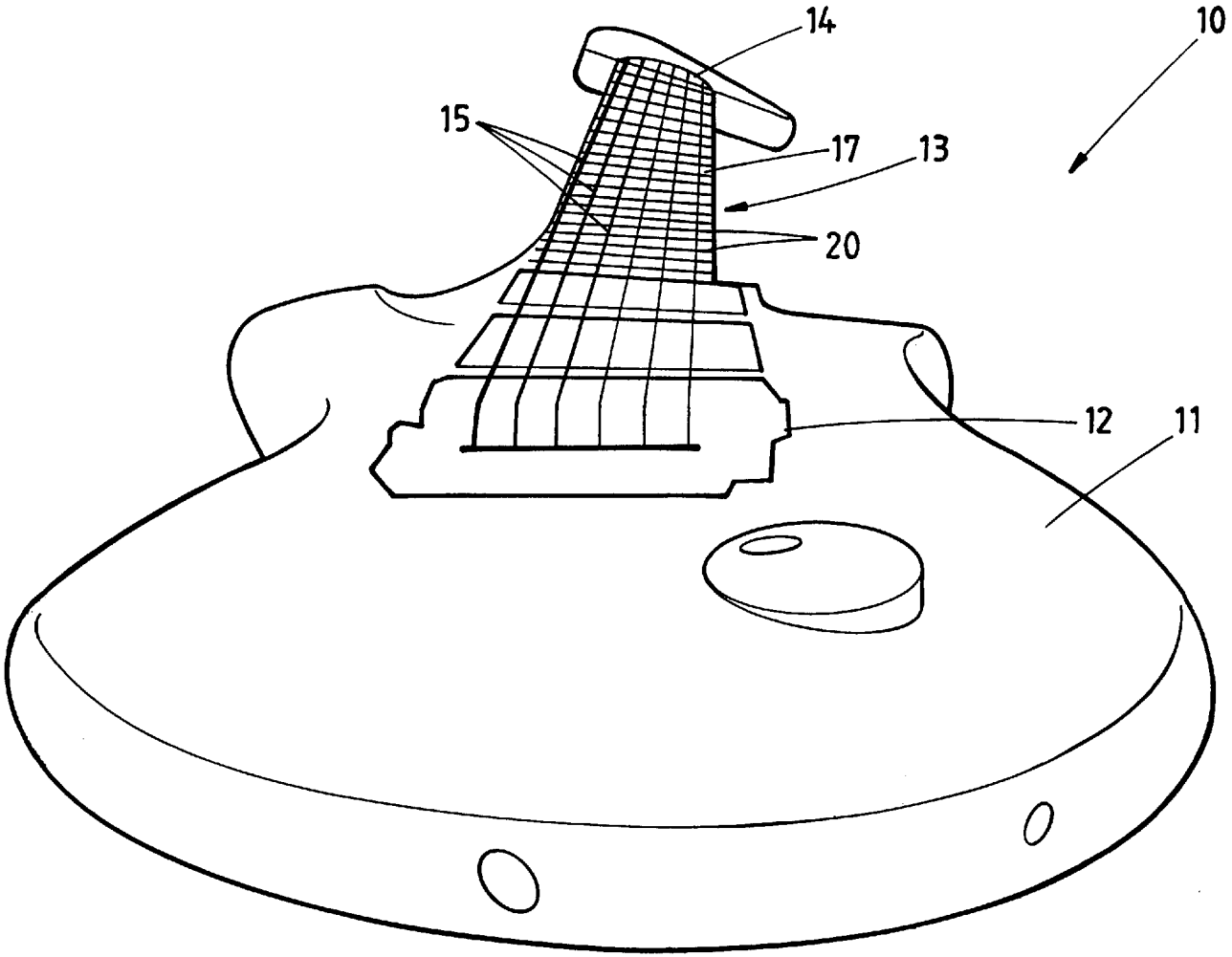
FIG. 1 is a perspective view of a right-handed stringed musical instrument looking along a length thereof in a direction of its distal end and which has an elongated string support, according to the present invention.

Referring to FIG. 1, one embodiment of a stringed musical instrument 10, according to the present invention, is shown. The stringed musical instrument 10 is a guitar such as an electronic guitar. It should be appreciated that the stringed musical instrument 10 may be a violin, banjo, cello or the like with either fretted or unfretted finger-boards.

The stringed musical instrument 10 includes a body 11, a bridge 12, and an elongated string support or neck 13, according to the present invention, which extends outwardly away from the body 11. The stringed musical instrument 10 also includes a string tension adjusting mechanism 14 which in this instance is located at a distal end of the neck 13 and a plurality of strings 15 which are held at one end by the bridge 12 and at the other end by the string tension adjusting mechanism 14.

The neck 13 includes a finger-board 17 which is provided with a nut 18 (identified as Point B in FIG. 2) which serves as an outer suspension point for the strings 15. The strings 15 are suspended between the bridge 12 and the nut 18 in a manner which allows them to vibrate freely when they are plucked, strummed, bowed or otherwise caused to vibrate in order to produce sound. The strings 15 follow in a parallel manner the major contour of the neck 13 and finger-board 17 and are in close proximity thereto.

In accordance with the present invention, the neck 13 is permanently twisted with the twist progressively increasing from zero at the point of the bridge 12 to an angle of less than ninety degrees (90°) at the string tension adjusting mechanism 14. Preferably, the neck 13 is longitudinally progressively twisted to an angle of approximately twenty degrees (20°) at its distal end, i.e., Point B. However it should be appreciated that the extent of twist may vary from instrument to instrument and can be varied, most preferably, between ten degrees (10°) and forty-five degrees (45°). The twist, as shown in FIGS. 2(*a*) and 2(*b*), can be in a clockwise or anti-clockwise direction, providing for both left- and right-hand players.

Figures 2, 2A, 2B:
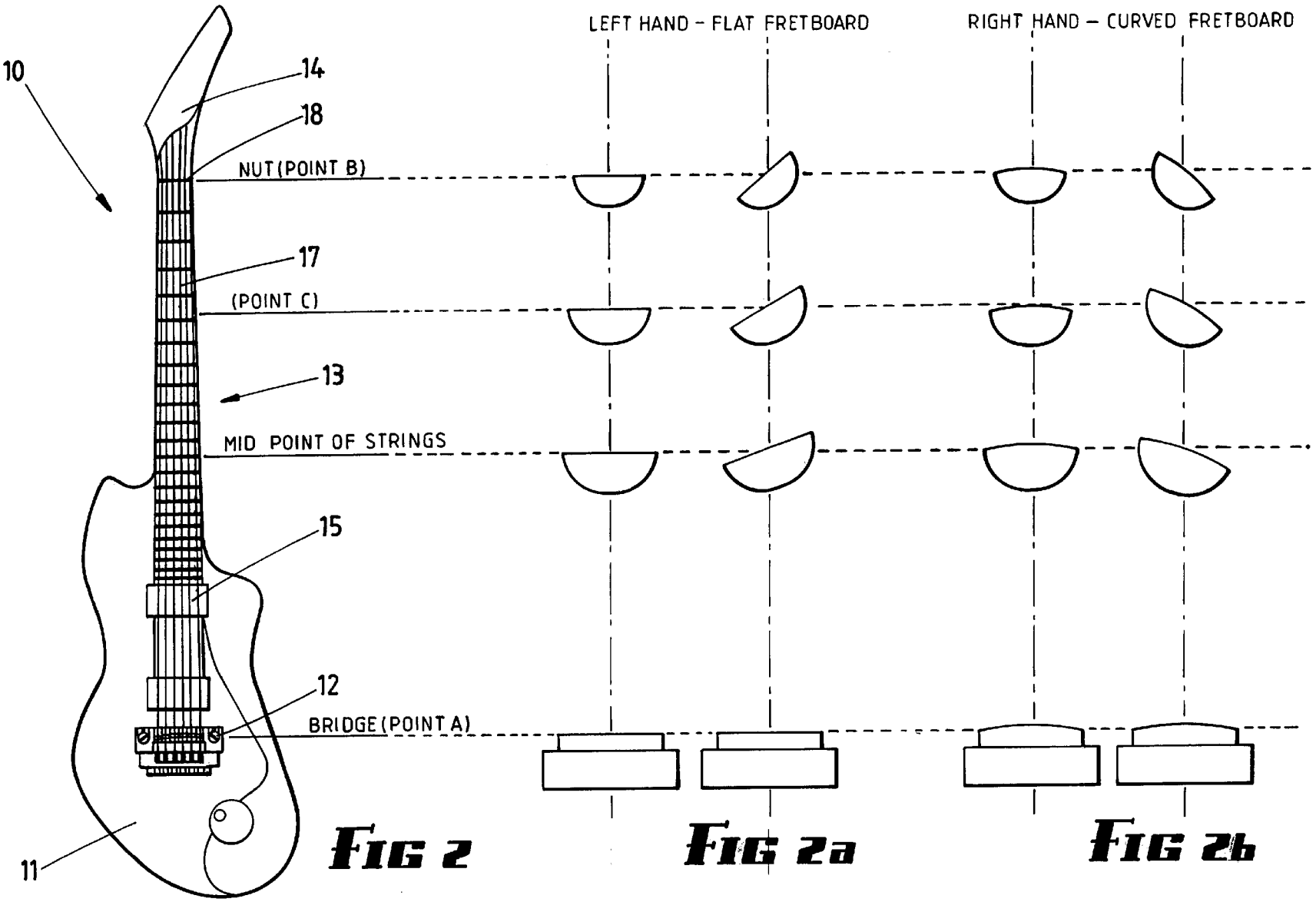
FIG. 2 is a plan view of the stringed musical instrument of FIG. 1.
Figure 3:
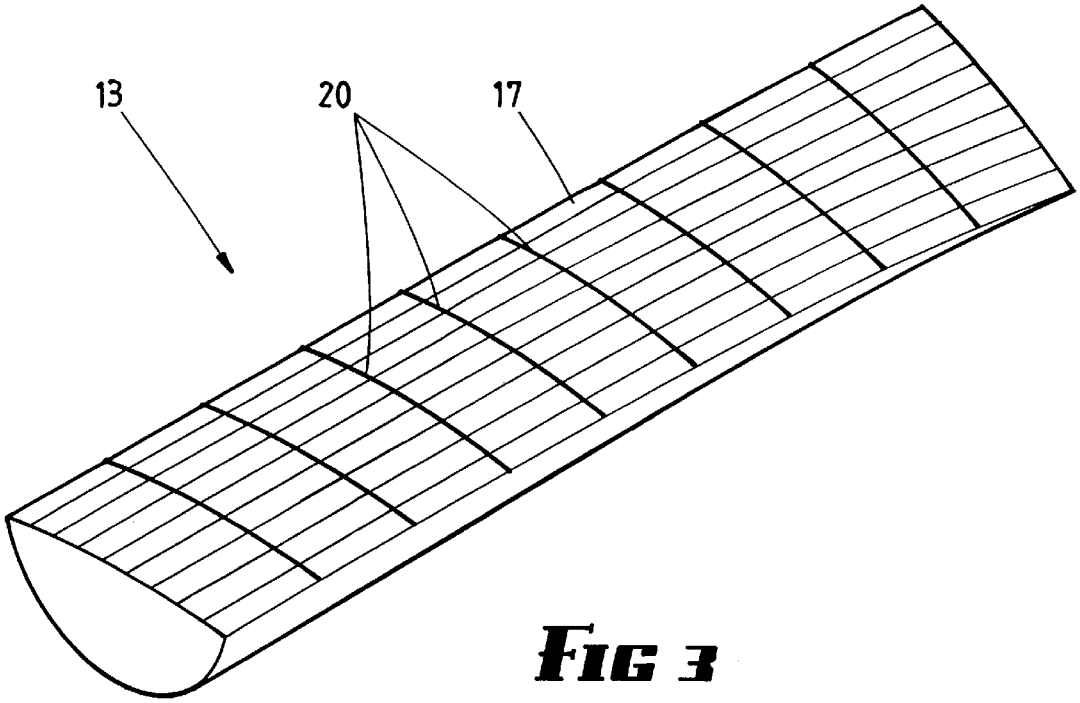
FIG. 3 is a partial perspective view of the elongated string support of the stringed musical instrument of FIG. 1.
Figure 4:
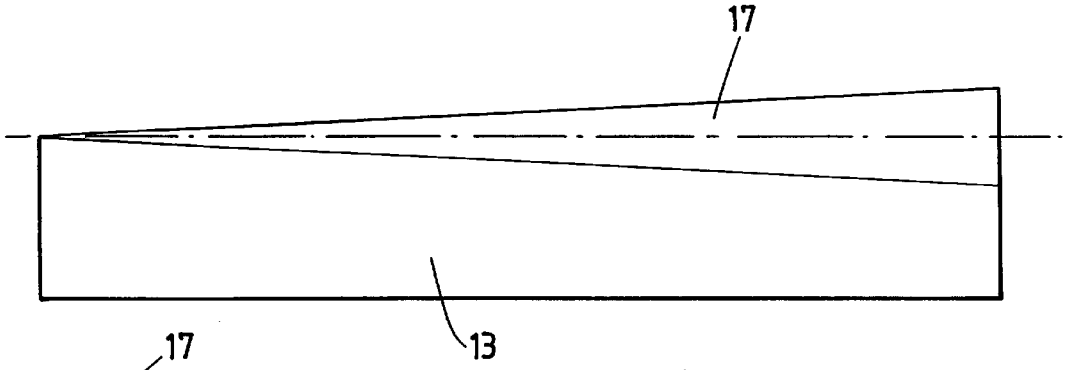
FIG. 4 is a side view of the elongated string support of FIG. 3.
Figure 5:
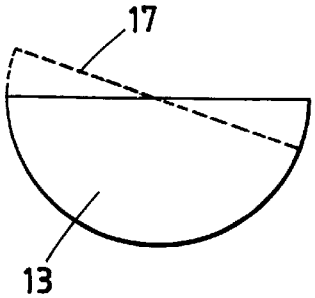
FIG. 5 is an end elevational view of the elongated string support of FIG. 3.

As illustrated in FIGS. 1 and 3, the finger-board 17 may be provided with a series of spaced apart transverse frets 20 which are inserted into slots formed in the finger-board 17. As shown in FIG. 2(*a*), the top surface of the finger-board 17 and the frets 20 are flat, whereas those shown in FIG. 2(*b*) of the drawing, are curved. It should be appreciated that stringed musical instruments may have either flat or curved top surfaces for the finger-boards and frets, where present, generally follow the shape of the finger-boards.

FIGS. 2(*a*) and 2(*b*) clearly illustrate the manner in which the neck 13 and its finger-board 17 are progressively twisted from the bridge 12 of the stringed musical instrument 10 to Point B which coincides with the location of the nut 18. Point C in FIG. 2 represents an intermediate location where the twist angle or angle of inclination of the top surface is slightly less than the twist angle of the neck at Point B. In this embodiment, the twisted neck 13 is formed as an integral part of the stringed musical instrument 10. It should be appreciated that the neck 13 can be in the form of a "bolt-on" attachment which can be detachably secured to the body 11 of the stringed musical instrument 10.

Figure 6:
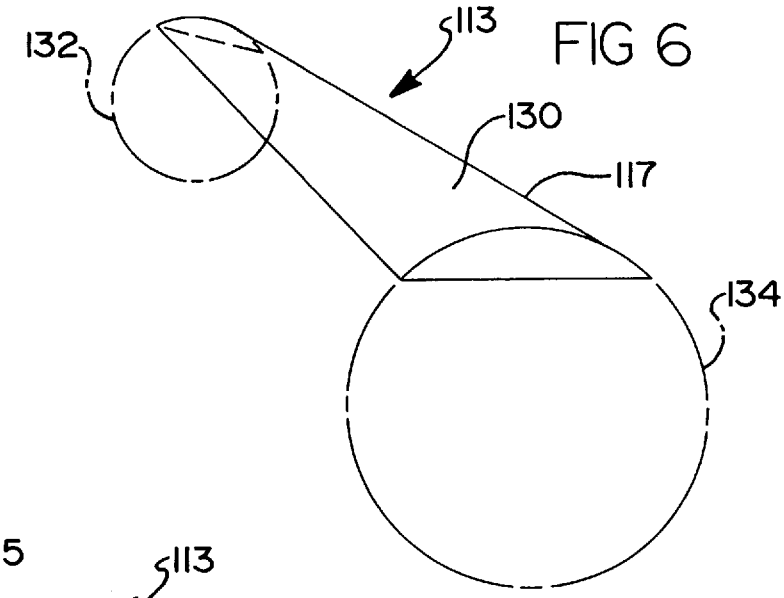
FIG. 6 is a perspective view of another embodiment, according to the present invention, of the elongated string support of the stringed musical instrument of FIG. 1.
Figure 7:
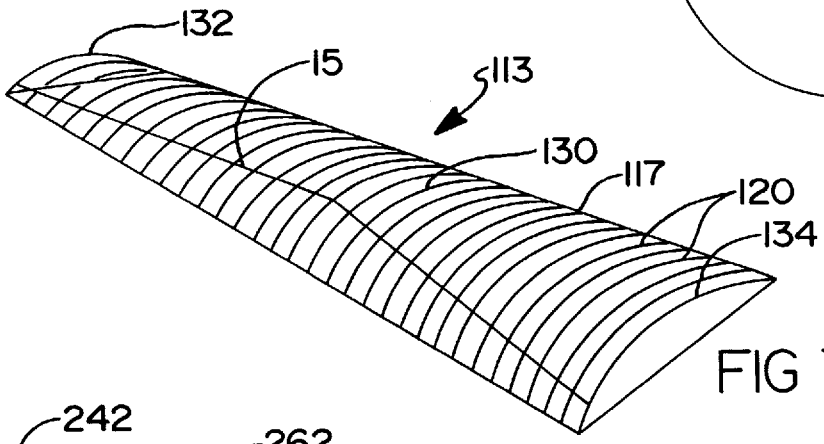
FIG. 7 is a view similar to FIG. 6 illustrating a string being bent.

Referring to FIG. 6, another embodiment 113, according to the present invention, is illustrated. Like parts of the twisted neck 13 have like reference numerals increased by one hundred (100). The twisted neck 113 has a finger-board 117 with a non-uniform radius for the top surface thereof. As defined herein, a "non-uniform" radius is either a compound radius or asymmetric radius or both in combination as described herein. Preferably, the twisted neck 113 has one end of a smaller radius as represented by circle 132 in phantom lines and has the other end of a larger radius represented by circle 134 in phantom lines. Preferably, the smaller radius 132 is at the distal end and the larger radius 134 is at the proximal end. The smaller radius 132 is two (2) inches to nine (9) inches and the larger radius 134 is nine (9) inches to twelve (12) inches. Preferably, the smaller radius 132 is seven (7) inches and the larger radius 134 is twelve (12) inches. The remainder of the surface 130 of the finger-board 117 between these two points is radiused to provide a uniform transition from the radius at one end to the other. Starting from the nut 118, each fret 120 toward the bridge 12 has a larger radius than the one above it, i.e., higher frets 120 closer to the bridge 12 are flatter than the frets 120 above them towards the nut 118. Such a finger-board surface 117 is defined herein as a "compound radiused" surface 130. It should be appreciated that the top of the bridge 12 is radiused suitably to allow the strings 15 to conform with the resultant shape of the neck 113 or finger-board 117, i.e., the radius of the bridge 12 will be greater than the larger radius 134. In operation, when a low string 15 is bent down towards a higher string 15, it is moved to a higher point on its fret 120, thus lifting the string 15 clear of the flatter frets 120 below it as illustrated in FIG. 7.

In another example, the compound radiused surface 130 of the finger-board 117 has the smaller radius 132 at the distal end of two (2) inches and the larger radius 134 at the proximal end of twelve (12) inches. The remainder of the surface 130 of the finger-board 117 between these two points is radiused to provide a uniform transition from one radius to the other. It should be appreciated that the radius at the last fret 120 is quite curved with all frets 120 toward the nut being able to provide lift to a string 15 being bent across it. It should also be appreciated that the fret clearances when bending strings is optimized.

Figure 8:
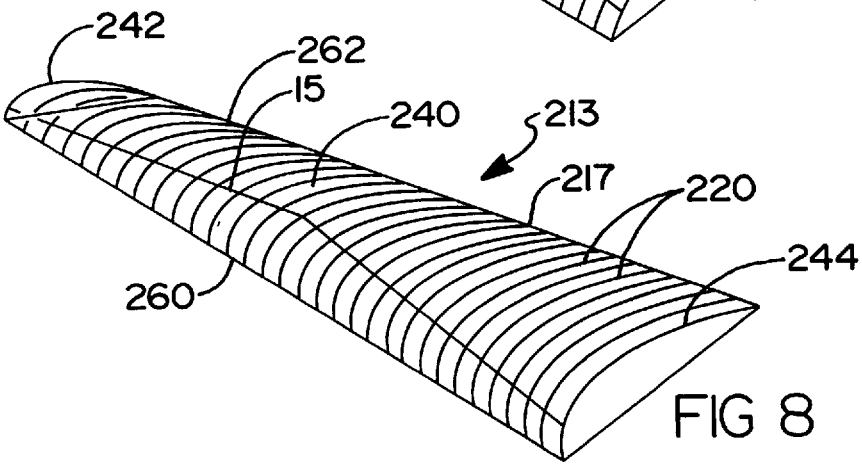
FIG. 8 is a perspective view of yet another embodiment, according to the present invention, of the elongated string support of the stringed musical instrument of FIG. 1.
Figure 9A:
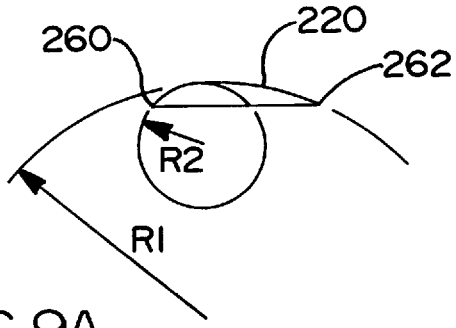
FIG. 9 is a cross-sectional view of asymmetric finger-boards formed by overlapping circles of different radii (FIG. 9A) or by taking a chord of an ellipse (FIG. 9B).
Figure 9B:
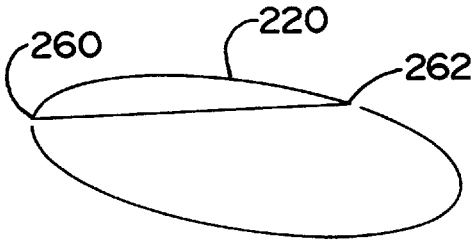

Referring to FIG. 8, yet another embodiment 213, according to the present invention, is illustrated. Like parts of the twisted neck 13 have like reference numbers increased by two hundred (200). The twisted neck 213 has a finger-board 217 with a non-uniform radius for the top surface thereof. Preferably, the non-uniform radius top surface is an "asymmetrically radiused" surface 240 as exemplified in FIGS. 8 and 9. The twisted neck 213 has one end of a smaller asymmetrically radiused shape 242 and has the other end of a larger asymmetrically radiused shape 244. Preferably, the smaller asymmetrically radiused shape 242 is at the distal end and the larger asymmetrically radiused shape 244 is at the proximal end. Preferably, a fret 220 at the distal end of the finger-board 217 has a two (2) inch radius (R2 in FIG. 9A) on a bass side 260 blending into a nine (9) inch radius (R1 in FIG. 9A) on a treble side 262 of the same fret 220. Such a fret 220 is defined herein as having an "asymmetric radius" formed, for example, by the convergence of the surface of two circles at a common tangent or part of an ellipse as illustrated in FIG. 9B. Preferably, a fret 220 at the proximal end of the finger-board 217 has seven (7) inch and twelve (12) inch radiuses on the bass side 260 and treble side 262, respectively. The remainder of the surface 240 of the finger-board 217 between those two points is graduated to provide a uniform transition from one end to the other giving a "compound asymmetrically radiused" surface as shown in FIG. 8. The asymmetrical radiused frets 220 will selectively serve to increase the distance that a bass string 15 lifts when it is pulled or bent down across such an asymmetrically shaped fret 220. The result is that the string 15 will be lifted higher for a given distance of lateral movement across the fret 220 when bending a string down as illustrated in FIG. 8. This will result in increased clearance between the string 15 being bent and the higher frets 220 toward the bridge 12 in order to reduce "choking" or "fret buzz". It should be appreciated that the finger-board 217 may have an asymmetrically radiused surface or a compound asymmetrically radiused surface.

Accordingly, the stringed musical instrument 10 of the present invention provides for a very simple, effective improvement to the string support of a stringed musical instrument which allows the player's wrist to be maintained in an essential neutral position at all points along the finger-board of the instrument, and enables the instrument to be played with a minimum of wrist strain but with maximum finger pressure. Also, the twisted neck 113, 213 has a non-uniform radius surface of either a compound radius surface 130 or a compound asymmetrically radiused surface 240 to render the stringed musical instrument 10 more playable under a wider range of player techniques and conditions. The compound radius surface 130 provides additional string to fret clearances over and above those provided by a uniformly radiused or curved fretboard. The compound asymmetrically radiused surface 240 selectively maximizes the clearance between a string 15 being bent down and the higher frets toward the bridge 12 and reduces the movement of lateral string bending movement required in order to attain the desired note pitch.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An elongated string support for a stringed musical instrument comprising:

a finger-board surface having a bass side and a treble side and extending between a proximal end and a distal end relative to the stringed musical instrument to support strings in close proximity thereto;

said finger-board surface following a longitudinally twisted path with an angle of twist increasing progressively from said proximal end to said distal end; and said finger-board surface having a non-uniform radius extending between at least either one of said bass side and said treble side and one of said proximal end and said distal end.

2. An elongated string support as set forth in claim 1 wherein said non-uniform radius is a compound radius between said proximal end and said distal end.

3. An elongated string support as set forth in claim 1 wherein said non-uniform radius is an asymmetrical radius between said bass side and said treble side.

4. An elongated string support as set forth in claim 1 wherein said non-uniform radius is a compound asymmetrical radius between said bass side and said treble side and between said proximal end and said distal end.

5. An elongated string support as set forth in claim 1 wherein said non-uniform radius has a radius of approximately two to nine inches at said distal end and a radius of approximately nine to twelve inches at said proximal end.

6. An elongated string support as set forth in claim 1 wherein the angle of twist at said distal end is between approximately 10° and 45°, most preferably approximately 20°, the angle of twist being measured relative to a flat reference plane which coincides with a transverse plane of a body of the stringed musical instrument.

7. An elongated string support as set forth in claim 1 wherein said finger-board surface is detachably connected to a body of the stringed musical instrument.

8. An elongated string support as set forth in claim 1 wherein said finger-board surface forms an integral part of and is nondetachably connected to body of the stringed musical instrument.

9. An elongated string support as set forth in claim 1 wherein said finger-board surface has an angle of inclination of less than 45° with respect to a flat transverse plane of a body of the stringed musical instrument at said distal end of a neck of the stringed musical instrument.

10. An elongated string support for a stringed musical instrument comprising:

a finger-board surface having a bass side and a treble side extending between a proximal end and a distal end relative to the stringed musical instrument to support strings in close proximity thereto;

said finger-board surface following a longitudinally twisted path with an angle of twist increasing progressively from said proximal end to said distal end; and said finger-board surface having a compound radius extending between said proximal end and said distal end.

11. An elongated string support as set forth in claim 10 wherein said compound radius has a radius at said distal end less than a radius at said proximal end.

12. An elongated string support as set forth in claim 10 wherein said compound radius extends between asymmetrically radiused shapes on said proximal end and said distal end.

13. An elongated string support as set forth in claim 10 wherein said compound radius has a radius of approximately two to nine inches at said distal end and a radius of approximately nine to twelve inches at said proximal end.

14. An elongated string support or neck as set forth in claim 12 wherein said asymmetrically radiused shapes have a radius of approximately two inches on said bass side and a radius of approximately nine inches on said treble side at said distal end and has a radius of approximately seven inches on said bass side and approximately twelve inches on said treble side at said proximal end.

15. An elongated string support for a stringed musical instrument comprising:

a finger-board surface having a bass side and a treble side extending between a proximal end and a distal end relative to the stringed musical instrument to support strings in close proximity thereto;

said finger-board surface following a longitudinally twisted path with an angle of twist increasing progressively from said proximal end to said distal end; and said finger-board surface having an asymmetrical radius extending between said bass side and said treble side.

16. An elongated string support as set forth in claim 15 wherein said asymmetrical radius has a compound radius between said proximal end and said distal end.

17. An elongated string support as set forth in claim 15 wherein said asymmetrical radius is greater on said treble side than on said bass side.

18. An elongated string support as set forth in claim 15 wherein said asymmetrical radius has a radius of approximately two inches to seven inches on said bass side and a radius of approximately nine inches to twelve inches on said treble side.

19. An elongated string support as set forth in claim 16 wherein said compound radius is approximately two inches on said bass side and approximately nine inches on said treble side at said distal end and approximately nine inches on said bass side and approximately twelve inches on said treble side at said proximal end.

* * * * *